US010309190B2

(12) United States Patent
June et al.

(10) Patent No.: US 10,309,190 B2
(45) Date of Patent: Jun. 4, 2019

(54) SYSTEM AND METHOD FOR ACCESSING A WELL

(71) Applicant: OneSubsea IP UK Limited, London (GB)

(72) Inventors: David R. June, Houston, TX (US); Venkatesh Bhat, Houston, TX (US); Christopher G. Kocurek, Houston, TX (US)

(73) Assignee: OneSubsea IP UK Limited, London (GB)

( * ) Notice: Subject to any disclaimer, the term of this patent is extended or adjusted under 35 U.S.C. 154(b) by 948 days.

(21) Appl. No.: 14/339,294

(22) Filed: Jul. 23, 2014

(65) Prior Publication Data

US 2016/0024878 A1 Jan. 28, 2016

(51) Int. Cl.

| | |
|---|---|
| ***E21B 33/04*** | (2006.01) |
| ***E21B 33/068*** | (2006.01) |
| ***E21B 34/02*** | (2006.01) |
| ***E21B 33/03*** | (2006.01) |
| ***E21B 33/035*** | (2006.01) |
| ***E21B 33/043*** | (2006.01) |
| ***E21B 33/047*** | (2006.01) |

(52) U.S. Cl.

CPC ..... *E21B 34/02* (2013.01); *E21B 33/03* (2013.01); *E21B 33/035* (2013.01); *E21B 33/04* (2013.01); *E21B 33/043* (2013.01); *E21B 33/047* (2013.01); *E21B 33/068* (2013.01)

(58) Field of Classification Search

CPC ..... E21B 33/035; E21B 34/04; E21B 33/043; E21B 33/03; E21B 33/04; E21B 33/047; E21B 34/02

See application file for complete search history.

(56) References Cited

U.S. PATENT DOCUMENTS

| | | | | | |
|---|---|---|---|---|---|
| 4,804,045 | A * | 2/1989 | Reed | E21B 33/03 | 166/313 |
| 4,903,774 | A | 2/1990 | Dykes et al. | | |
| 5,148,865 | A * | 9/1992 | Reed | E21B 33/03 | 166/76.1 |
| 5,544,707 | A * | 8/1996 | Hopper | E21B 33/03 | 166/368 |
| 5,577,556 | A * | 11/1996 | Reed | E21B 33/04 | 166/75.14 |
| 6,076,605 | A * | 6/2000 | Lilley | E21B 33/035 | 166/344 |

(Continued)

FOREIGN PATENT DOCUMENTS

| | | | | |
|---|---|---|---|---|
| GB | 2319795 A * | 6/1998 | ..... | E21B 33/035 |
| GB | 2358207 A * | 7/2001 | ..... | E21B 33/043 |

(Continued)

*Primary Examiner* — Daniel P Stephenson

(74) *Attorney, Agent, or Firm* — Eubanks PLLC

(57) ABSTRACT

A system and method for accessing a well, in certain embodiments, includes a production tree, a cap, and a spool including a longitudinal bore configured to receive a tubing hanger. The tubing hanger includes a longitudinal bore configured to transfer product between the spool and the production tree. At least one adjustable fluid barrier is included in the tubing hanger and/or the cap. The adjustable fluid barrier can be used to open and close the longitudinal passage and allow access through the tubing hanger and/or the cap.

72 Claims, 7 Drawing Sheets

(56) References Cited

U.S. PATENT DOCUMENTS

| | | | | |
|---|---|---|---|---|
| 6,076,695 | A | 6/2000 | Palvoelgyi et al. | |
| 6,082,460 | A * | 7/2000 | June | E21B 33/04 166/348 |
| 6,520,263 | B2 * | 2/2003 | June | E21B 33/043 166/348 |
| 6,612,368 | B2 * | 9/2003 | Kent | B24B 37/04 166/75.13 |
| 6,715,554 | B1 | 4/2004 | Cunningham et al. | |
| 6,729,392 | B2 | 5/2004 | DeBerry et al. | |
| 7,096,937 | B2 | 8/2006 | Bartlett et al. | |
| 7,331,396 | B2 * | 2/2008 | Reimert | E21B 33/035 166/319 |
| 2003/0006042 | A1 * | 1/2003 | DeBerry | E21B 33/035 166/368 |
| 2004/0112604 | A1 * | 6/2004 | Milberger | E21B 33/043 166/368 |
| 2004/0262010 | A1 * | 12/2004 | Milberger | E21B 33/043 166/368 |
| 2010/0307763 | A1 | 12/2010 | Moe | |
| 2012/0048567 | A1 * | 3/2012 | June | E21B 33/035 166/368 |
| 2016/0024878 | A1 * | 1/2016 | June | E21B 33/068 166/373 |

FOREIGN PATENT DOCUMENTS

| | | | | |
|---|---|---|---|---|
| GB | 2397312 | A * | 7/2004 | E21B 33/035 |
| GB | 2408275 | A * | 5/2005 | E21B 33/035 |
| WO | WO 0047864 | A1 * | 8/2000 | E21B 33/035 |
| WO | WO 2013027081 | A1 * | 2/2013 | E21B 33/035 |

* cited by examiner

SYSTEM AND METHOD FOR ACCESSING A WELL

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations. Sometimes it is difficult, as well as expensive, to get direct downhole access during a subsea workover operation.

DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
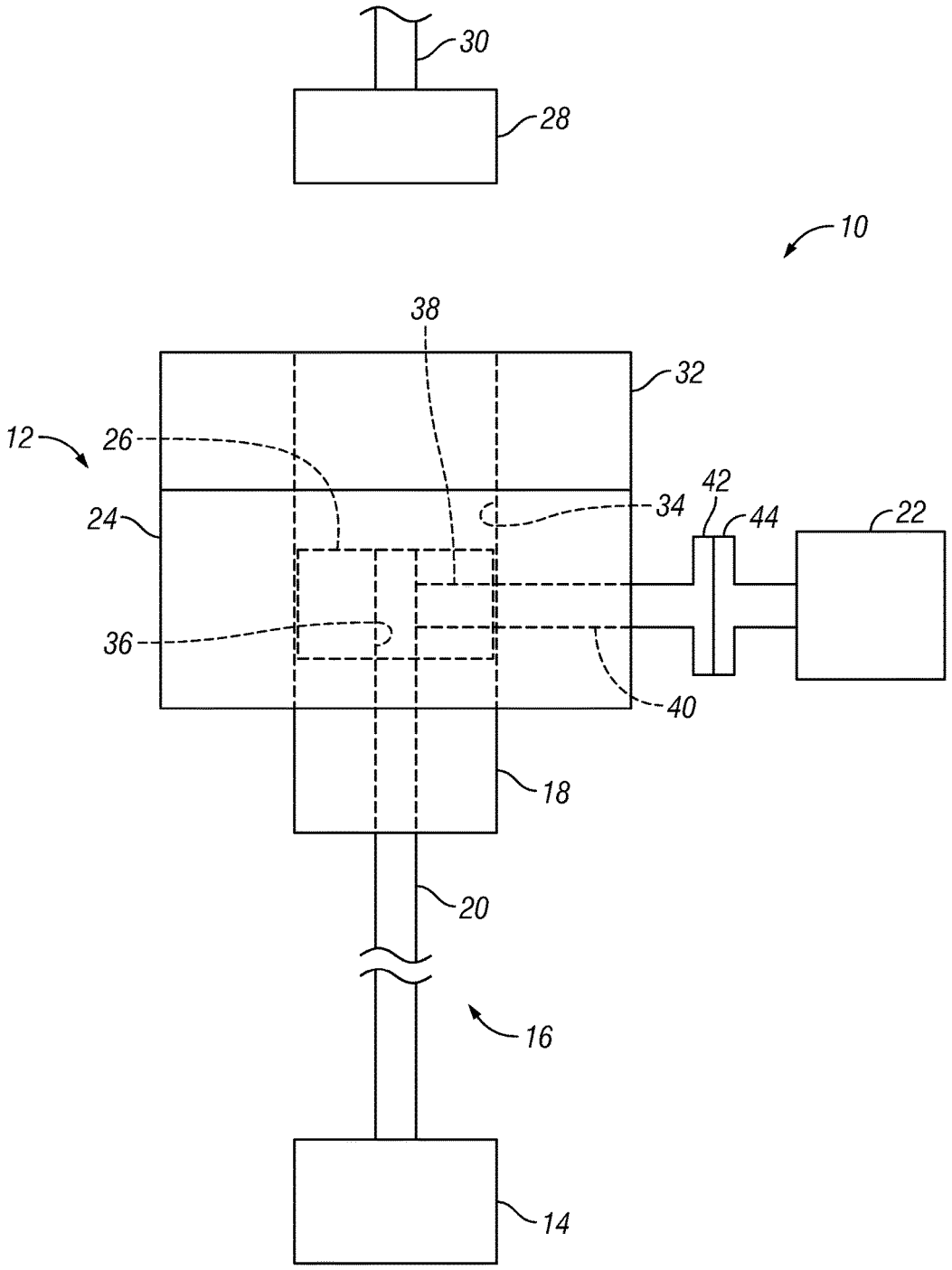
FIG. 1 is an illustrative completion system.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Various arrangements of production control valves may be coupled to a wellhead in an assembly generally known as a tree, such as a vertical tree or a horizontal tree. With a vertical tree, after the tubing hanger and production tubing are installed in the high pressure wellhead housing or a spool such as a tubing spool, a blowout prevent (BOP) may be removed and the vertical tree may be locked and sealed onto the wellhead. The vertical tree includes one or more production passages containing actuated valves that extend vertically to respective lateral production fluid outlets in the vertical tree. The production passages and production valves are thus in-line with the production tubing.

With a vertical tree, the tree may be removed while leaving the completion (e.g., the production tubing and hanger) in place. However, to pull the completion, the vertical tree must be removed and replaced with a BOP, which involves setting and testing plugs or relying on down-hole valves, which may be unreliable due to lack of use and/or testing. Moreover, removal and installation of the tree and BOP assembly generally requires robust lifting equipment, such as a rig, that may have high daily rental rates, for instance. The well is also in a vulnerable condition while the vertical tree and BOP are being exchanged and neither of these pressure-control devices is in position.

Alternatively, trees with the arrangement of production control valves offset from the production tubing, generally called horizontal trees or spool trees, may be utilized. A spool tree also locks and seals onto the wellhead housing. However, the tubing hanger, instead of being located in the wellhead, locks and seals in the tree passage. After the tree is installed, the tubing string and tubing hanger are run into the tree using a tubing hanger running tool. A production passage extends through the tubing hanger, and seals to prevent fluid leakage, thereby facilitating a flow of production fluid into a corresponding production passage in the tree. A locking mechanism above the production seals locks the tubing hanger in place in the tree. With the production valves offset from the production tubing, the production tubing hanger and production tubing may be removed from the tree without having to remove the spool tree from the wellhead housing. Unfortunately, if the tree needs to be removed, the entire completion must also be removed, which takes considerable time and also involves setting and testing plugs or relying on down-hole valves, which may be unreliable due to lack of use and/or testing. Additionally, because the locking mechanism on the tubing hanger is above and blocks access to the production port seals, the entire completion must be pulled to service the seals.

To manage expected maintenance costs, which are especially high for an offshore well, an operator may select equipment best suited for the expected type of maintenance. For example, a well operator may predict whether there will be a greater need in the future to pull the tree from the well for repair, or pull the completion, either for repair or for additional work in the well. Depending on the predicted maintenance events, an operator will decide whether the horizontal or vertical tree, each with its own advantages and disadvantages, is best suited for the expected conditions. For instance, with a vertical tree, it is more efficient to pull the tree and leave the completion in place. However, if the completion needs to be pulled, the tree must be pulled as well, increasing the time and expense of pulling the completion. Conversely, with a spool tree, it is more efficient to pull the completion, leaving the tree in place. However, if the tree needs to be pulled, the entire completion must be pulled as well, increasing the time and expense of pulling the tree. The life of the well could easily span 20 years and it is difficult to predict at the outset which capabilities are more desirable for maintenance over the life of the well. Thus, an incorrect prediction may significantly increase the cost of production over the life of the well. Further, jurisdiction regulations and other industry practices require the plugs on subsea equipment to include dual seal barriers between fluids in the well and open water environments, a so-called dual barrier requirement. With the production control equipment located at the surface, another system for accomplishing dual barrier protection is needed.

FIG. 1 is a block diagram that illustrates an exemplary well completion system 10. The illustrated well completion system 10 can be configured to extract various minerals and natural resources, including hydrocarbons (e.g., oil and/or natural gas), or configured to inject substances into the earth. In some embodiments, the well completion system 10 is land-based (e.g., a surface system) or subsea (e.g., a subsea system). As illustrated, the system 10 is a subsea system that includes a wellhead 12 coupled to a mineral deposit 14 via a well 16, wherein the well 16 includes a wellhead hub 18, which can be a high pressure wellhead housing and a well bore 20. The wellhead hub 18 generally includes a large diameter hub that is disposed at the termination of the well bore 20. The wellhead hub 18 provides for the connection of the wellhead 12 to the well 16. Although described as a subsea system, it should be appreciated that the well completion system 10 may also be used as surface system.

The wellhead 12 typically includes multiple components that control and regulate activities and conditions associated with the well 16. For example, the wellhead 12 generally includes bodies, valves, and seals that route produced minerals from the mineral deposit 14, provide for regulating pressure in the well 16, and provide for the injection of chemicals into the well bore 20 (downhole). In the illustrated embodiment, the wellhead 12 includes a subsea tree 22, a spool 24 (e.g., a tubing spool), and a tubing hanger 26. The system 10 may include other devices that are coupled to the wellhead 12, and devices that are used to assemble and control various components of the wellhead 12. For example, in the illustrated embodiment, the system 10 includes a tubing hanger running tool (THRT) 28 suspended from a drill string 30. In certain embodiments, the THRT 28 is lowered (e.g., run) from an offshore vessel to the well 16 and/or the wellhead 12. A blowout preventer (BOP) 32 may also be included, and may include a variety of valves, fittings and controls to block oil, gas, or other fluid from exiting the well in the event of an unintentional release of pressure or an overpressure condition.

As illustrated, the spool 24 is coupled to the wellhead hub 18. Typically, the spool 24 is one of many components in a modular subsea or surface completion system 10 that is run from an offshore vessel or surface system. The spool 24 includes a longitudinal passage 34 configured to support the tubing hanger 26. In addition, the passage 34 may provide access to the well bore 20 for various completion and workover procedures. For example, components can be run down to the wellhead 12 and disposed in the spool passage 34 to seal-off the well bore 20, to inject chemicals down-hole, to suspend tools down-hole, to retrieve tools down-hole, and the like.

Figure 2:
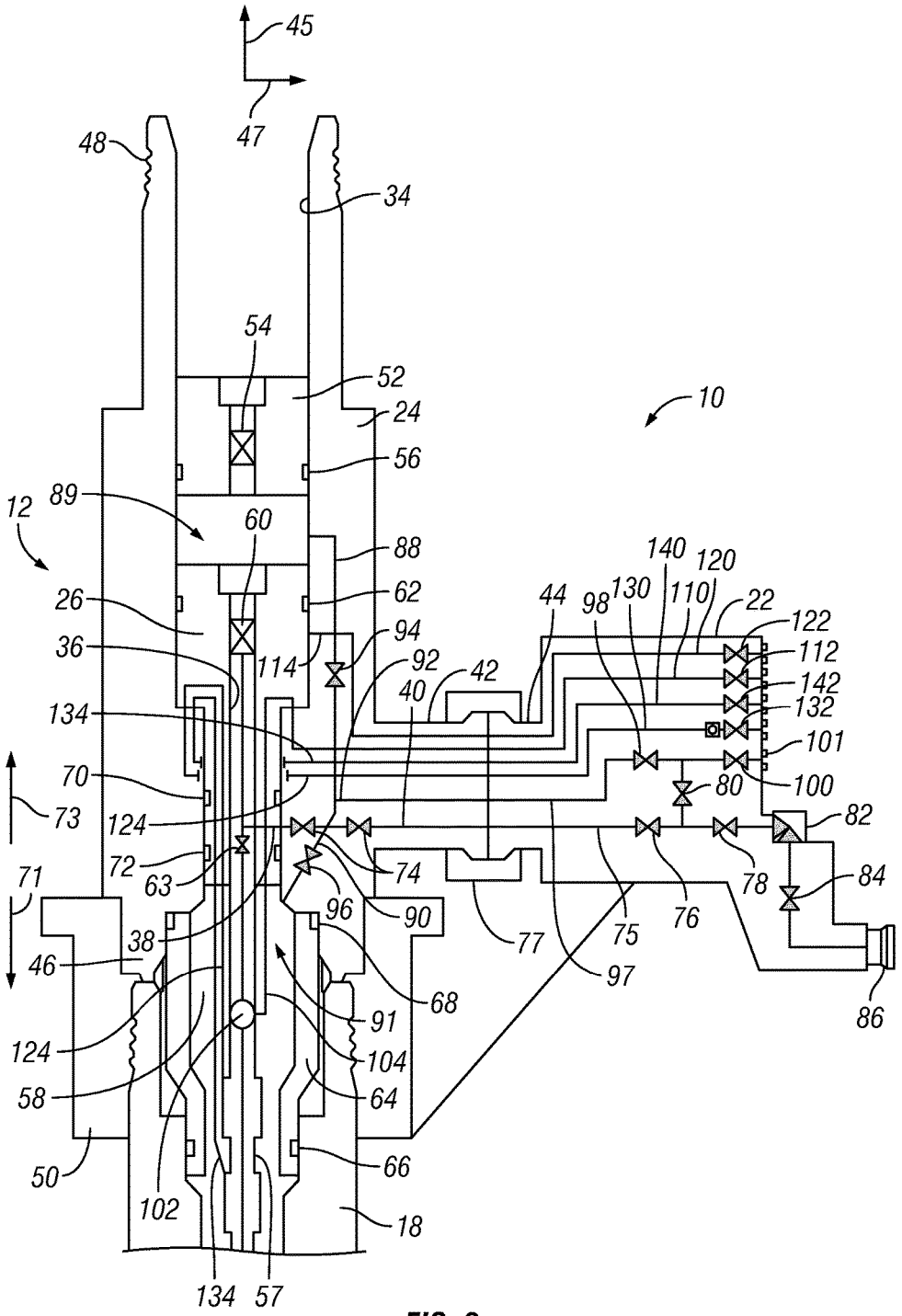
FIG. 2 is a cross-sectional side view of an illustrative embodiment of a completion system arrangement.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, well completion systems 10 employ various mechanisms, such as mandrels, seals, plugs and valves, to control and regulate the well 16. For example, the illustrated tubing hanger 26 is typically disposed within the wellhead 12 to secure tubing suspended in the well bore 20, and to provide a path for hydraulic control fluid, chemical injections, and the like. The hanger 26 includes a longitudinal bore 36 that extends through the center of the hanger 26, and that is in fluid communication with the well bore 20. As illustrated in the embodiment of FIG. 2, the hanger 26 also includes a lateral flow passage 38 in fluid communication with the longitudinal passage 36. The lateral flow passage 38 of the tubing hanger 26 is configured to transfer product (e.g., oil, natural gas, etc.) from the longitudinal tubing hanger passage 36 to a lateral flow passage 40 of the spool 24. In the present embodiment, the lateral flow passage 40 of the spool 24 extends from the longitudinal spool passage 34 to a hub connection 42. The hub connection 42 is configured to interface with a mating hub connection 44 of the subsea tree 22, thereby establishing a flow path from the longitudinal passage 36 of the tubing hanger 26 through the lateral flow passages 38 and 40 and into the subsea tree 22. While the interface between the hub connection 42 and the mating hub connection 44 is oriented along a plane substantially parallel to the longitudinal passage 34 of the spool 24, it should be appreciated that alternative embodiments may employ an interface along a plane substantially perpendicular to the longitudinal passage 34.

FIG. 2 is a cross-sectional side view of an embodiment of a spool 24 and subsea tree 22 that may be used in the completion system 10. As previously discussed, the spool 24 is configured to be positioned between the wellhead hub 18 and the BOP 32. Consequently, the spool 24 includes a first end 46 configured to interface with the wellhead hub 18, and a second end 48 configured to interface with the BOP 32. The longitudinal passage 34 extends in an axial direction 45 between the first end 46 and the second end 48, thereby establishing a flow path through the spool 24. In the present embodiment, a collet connector 50 serves to secure the first end 46 of the spool 24 to the wellhead hub 18. In addition, a cap 52 (e.g., an internal tree cap) is disposed within the longitudinal passage 34 between the tubing hanger 26 and the second end 48 to block fluid flow into and out of the spool 24. As illustrated, the cap 52 includes a fluid barrier 54, such as a wireline plug, and a seal 56, such as a rubber o-ring, for example. More than one fluid barrier 54 may also be used. As will be appreciated, the cap 52 may include a locking mechanism configured to secure the cap 52 to the longitudinal passage 34 of the spool 24. Consequently, the cap 52 may be retrieved by releasing the locking mechanism, and then extracting the cap 52 from the passage 34. In addition, the plug may be removable (e.g., via a wireline) to provide fluid communication with the longitudinal passage 34. In addition, the fluid barrier 54 may be an adjustable barrier, such as an actuatable valve. The valve may be any suitable valve, such as by non-limiting example, a ball valve, a sliding sleeve valve, a shuttle valve, or a gate valve. The adjustable barrier(s) can thus open and close a longitudinal passage running through the cap 52 to allow mechanical and circulation access through the cap during workover operations, without having to pull plugs in the cap 52.

More than one fluid barrier 54 may also be used in the cap 52 and the fluid barriers 54 may be different types, such as one plug and one valve.

As previously discussed, the tubing hanger 26 is configured to support a tubing string 57 that extends down the well bore 20 to the mineral deposit 14. As will be appreciated, an annulus 58 of the spool 24 surrounds the tubing string 57, and may be filled with completion fluid. A fluid barrier 60, such as a plug or an adjustable barrier, is disposed within the longitudinal passage 36 of the tubing hanger 26 and serves as a barrier between the product extracted from the mineral deposit 14 and the completion fluid within the annulus 58. The tubing hanger 26 may also include a profile for installing a fluid barrier 60 in the hanger longitudinal passage 36. Thus, a fluid barrier 60 such as a plug or an actuatable valve may be interchangeable in the profile. More than one barrier 60 may also be used. Consequently, the barrier 60 may block the flow of fluid up through the top of the tubing hanger 26. The barrier 60 may be an adjustable barrier such as an actuatable valve. The valve may be any suitable valve, such as by non-limiting example, a ball valve, a sliding sleeve valve, a shuttle valve, or a gate valve. The valve may be actuated electrically, hydraulically, mechanically, or by any other suitable means. More than one barrier 60 may also be used. The valve can thus open and close the longitudinal passage 36 of the tubing hanger 26 to allow direct downhole mechanical and circulation access during workover operations, without having to pull crown plugs in the tubing hanger 26.

At least one of the barriers 54, 60 is an adjustable barrier. If a barrier 54 or 60 is not an adjustable barrier, it is a non-adjustable barrier, such as a removable plug. Any combination of barriers where at least one of the barriers is adjustable may be used. For example, all of the barriers 54, 60 may be adjustable barriers.

In addition, the tubing hanger 26 includes a seal 62 (e.g., rubber o-ring) disposed against the longitudinal passage 34 of the spool 24 and configured to block fluid flow around the tubing hanger 26. The illustrated wellhead configuration also includes an isolation sleeve 64 disposed within the passage 34, and extending from the first end 46 of the spool 24 to the wellhead hub 18. As illustrated, the isolation sleeve 64 includes a first seal 66 (e.g., rubber o-ring) in contact with the passage of the wellhead hub 18, and a second seal 68 (e.g., rubber o-ring) in contact with the passage 34 of the spool 24. In this configuration, the isolation sleeve 64 may facilitate pressure testing of the seal between the wellhead hub 18 and the spool 24. The isolation sleeve 64 may also serve as an additional barrier to block a flow of completion fluid from exiting the wellhead 12 through the interface between the spool 24 and the wellhead hub 18.

Furthermore, the tubing hanger 26 includes a first seal 70 positioned adjacent to the passage 34 of the spool 24, and located in a downward direction 71 from the lateral flow passage 38. The tubing hanger 26 also includes a second seal 72 positioned adjacent to the passage 34, and located in an upward direction 73 from the lateral flow passage 38. In the present embodiment, the seals 70 and 72 are configured to block flow of completion fluid into the lateral flow passage 38, and to block flow of product (e.g., oil and/or natural gas) into the annulus 58. Consequently, a flow path will be established between the tubing string 57 and the lateral flow passage 40 of the spool 24, thereby facilitating the flow of product to the subsea tree 22. Specifically, product will flow from the tubing string 57 in the upward direction 73 into the longitudinal passage 36 of the tubing hanger 26. Because the actuatable valve 60 blocks the flow of product from exiting the top of the tubing hanger 26, the product will be directed through the lateral flow passage 38 of the tubing hanger 26 and into the lateral flow passage 40 of the spool 24. The product will then flow into the subsea tree 22 via the interface between the hub connection 42 and the mating hub connection 44. While the actuatable valve 60 serves to block the flow of product out of the top of the tubing hanger 26, it should be appreciated that the plug 54 within the cap 52 serves as a backup seal to block product from exiting the spool 24, thereby providing a dual barrier between the product and the environment.

In the present embodiment, the spool 24 includes one or more valves 74, such as production valves, coupled to the lateral flow passage 40. As shown, the spool includes both production valves 74 but it should also be appreciated that only one production valve 74 may be included. It should also be appreciated that the term "production" as used to describe valve 74 is for convenience and that the valve 74 may be used to regulate flow in either direction and for injection as well as production. The production valves 74 are configured to control the flow of product between the spool 24 and the tree 22. For example, one or both of the production valves 74 may be closed prior to retrieving the tree 22, thereby blocking the flow of product from entering the environment. Conversely, once the tree 22 has between run or lowered into position, the valves 74 may be opened to facilitate product flow to the subsea tree 22. When two production valves 74 are used and both in respective closed positions, two barriers are provided between the product flow and the environment, even when the tree 22 is removed. While the present embodiment includes valves 74, it should be appreciated that alternative embodiments may employ any suitable device (e.g., wireline plug) configured to substantially block production flow from the well 16 to the hub connection 42. As illustrated, with the hub connection 42 coupled to the mating hub connection 44, the lateral flow passage 40 of the spool 24 is in fluid communication with a product flow passage 75 of the subsea tree 22. In the present embodiment, the hub connection 42 is coupled to the mating hub connection 44 with a clamp 77, such as a manual clamp or a hydraulic connector.

In the present embodiment, the product flow passage 75 includes a first valve 76 and a second valve 78. As illustrated in FIG. 2, the first valve 76 is positioned upstream of an annulus crossover valve 80, and the second valve 78 is positioned downstream from the annulus crossover valve 80. Valves 76 and 78 may be first and second production valves. As discussed in detail below, the valves 76, 78 and 80 may be controlled to vary fluid flow into and out of the annulus 58 and tubing string 57. In addition, the product flow passage 75 includes a choke 82 positioned downstream from the valves 76 and 78, and configured to regulate pressure and/or flow rate of product through the flow passage 75. The flow passage 75 also includes a flowline isolation valve 84 configured to selectively block fluid flow between the tree 22 and the surface. As illustrated, the product flow passage 75 terminates at a flowline hub 86 configured to interface with a conduit or manifold that conveys the product from the wellhead 12 to a surface vessel or platform.

Because the tubing hanger 26 is substantially sealed to the passage 34 of the spool 24 via the seals 62, 70, and 72, flow of completion fluid through the annulus 58 is blocked. Consequently, the spool 24 includes an upper annulus flow passage 88 and a lower annulus flow passage 90 to regulate completion fluid pressure within an upper region 89 above the tubing hanger 26 and a lower region 91 below the tubing hanger 26, respectively. Specifically, the upper annulus flow passage 88 extends from the upper region 89 to a lateral flow passage 92, and the lower annulus flow passage 90 extends from the lateral flow passage 92 to the lower region 91. In this configuration, completion fluid may be supplied and/or removed from each region 89 and 91 of the annulus 58. In the present embodiment, the upper annulus flow passage 88 includes an upper annulus valve 94, and the lower annulus flow passage 90 includes a lower annulus valve 96. The valves 94 and 96 are configured to control fluid flow to the upper region 89 and lower region 91, respectively.

As illustrated, the lateral annulus flow passage 92 extends through the hub connection 42 and interfaces with an annulus flow passage 97 of the subsea tree 22, thereby establishing a completion fluid flow path between the spool 24 and the subsea tree 22. In the present embodiment, the annulus flow passage 97 includes an annulus valve 98 positioned upstream of the annulus crossover valve 80, and an annulus monitor valve 100 positioned downstream from the annulus crossover valve 80. As will be appreciated, the annulus valves 98 and 100 may be controlled along with the valves 76 and 78 and the annulus crossover valve 80 to adjust fluid flow to and from the annulus 58 and the tubing string 57. For example, if the annulus valve 98, the annulus monitor valve 100, the first valve 76, and the second valve 78 are in the open position, and the annulus crossover valve 80 is in the closed position, then a fluid connection will be established between the flowline hub 86 and the tubing string 57, and between an annulus junction 101 and the annulus 58.

In the present embodiment, the tubing hanger 26 includes a valve 63, or other closure element below the lateral flow passage 38. The valve 63 is configured to selectively block product flow to the subsea tree 22 and may be operated hydraulically or otherwise. The valve 63 may also be included in a sub or other extension below the tubing hanger 26. The valve 63 works together with the barrier 60 but also with the valve 102 (discussed below) to provide an environmental barrier to fluid flow, such as production fluid flow, when either the subsea tree 22 or the cap 52 are not installed.

In the present embodiment, the tubing string 57 includes a downhole valve 102, such as for example a surface-controlled subsurface safety valve (SCSSV) 102 configured to selectively block product flow to the subsea tree 22. For example, as an SCSSV, the valve 102 may be hydraulically operated and biased toward a closed position (i.e., failsafe closed) to ensure that the SCSSV closes if the system experiences a reduction in hydraulic pressure. With at least two of the downhole valve 102, the valve 63, and at least one or both of the valves 74 in respective closed positions, two barriers are provided between the fluid flow and the environment, even when the tree 22 is removed. In the present embodiment, the SCSSV 102 is hydraulically controlled via a conduit 104 extending from the hub connection 42 to the SCSSV 102. As illustrated, the conduit 104 connects with a conduit 110 within the subsea tree 22 when the hub connection 42 is mounted to the mating hub connection 44, thereby establishing a fluid connection between the conduit 104 within the spool 24 and the conduit 110 within the subsea tree 22. The connection may be any type of sealing connection, such as a stab connection. The connection may also be configured to substantially block fluid flow into and out of the respective conduits 104 and 110 when disengaged. As illustrated, the conduit 110 is coupled to a valve 112 configured to selectively block hydraulic fluid flow to the downhole valve 102.

The spool 24 also includes a vent/test conduit 114 configured to regulate fluid flow to certain regions of the tubing hanger 26. As illustrated, the conduit 114 connects with a conduit 120 within the subsea tree 22 when the hub connection 42 is mounted to the mating hub connection 44, thereby establishing a fluid connection between the conduit 114 within the spool 24 and the conduit 120 within the subsea tree 22. The connection may be any type of sealing connection, such as a stab connection. The connection may also be configured to substantially block fluid flow into and out of the respective conduits 114 and 120 when disengaged. As illustrated, the conduit 120 is coupled to a valve 122 configured to selectively block fluid flow to the vent/test conduit 114.

In the present embodiment, the spool 24 also includes a chemical injection conduit 124 configured to inject chemicals, such as methanol, polymers, surfactants, etc., into the well bore 20 to improve recovery. As illustrated, the conduit 124 connects with a conduit 130 within the subsea tree 22 when the hub connection 42 is mounted to the mating hub connection 44, thereby establishing a fluid connection between the conduit 124 within the spool 24 and the conduit 130 within the subsea tree 22. The connection may be any type of sealing connection, such as a stab connection. The connection may also be configured to substantially block fluid flow into and out of the respective conduits 124 and 130 when disengaged. As illustrated, the conduit 130 is coupled to a valve 132 configured to selectively block the flow of chemicals into the well bore 20.

In the present embodiment, the spool 24 also includes another hydraulic conduit 134 configured to operate a sliding sleeve within the tubing string 57. For example, the tubing string 57 may terminate in a first region of the mineral deposit 14 and the sliding sleeve may be aligned with a second region of the mineral deposit 14. In this configuration, when the sliding sleeve is in a closed position, the tubing string 57 may extract product from the first region. Conversely, when the sliding sleeve is in an open position, the tubing string 57 may extract product from the second region. Consequently, product may be selectively extracted from various regions of the mineral deposit 14 with a single tubing string 57. As illustrated, the conduit 134 connects with a conduit 140 within the subsea tree 22 when the hub connection 42 is mounted to the mating hub connection 44, thereby establishing a fluid connection between the conduit 134 within the spool 24 and the conduit 140 within the subsea tree 22. The connection may be any type of sealing connection, such as a stab connection. The connection may also be configured to substantially block fluid flow into and out of the respective conduits 134 and 140 when disengaged. As illustrated, the conduit 140 is coupled to a valve 142 configured to selectively block hydraulic fluid flow to the sliding sleeve.

While the present embodiment includes four conduits 104, 114, 124 and 134 extending from the subsea tree 22 to the spool 24, it should be appreciated that alternative embodiments may include more or fewer conduits. For example, certain embodiments may include additional valves controlled by additional hydraulic conduits, additional sliding sleeves controlled by additional conduits and/or additional chemical injection conduits.

If valve maintenance is desired, the tree 22 may be pulled by a ship, thereby substantially reducing maintenance costs compared to spool tree configurations in which a rig is employed to retrieve the spool tree.

Similarly, the tubing hanger 26 may be retrieved without removing the subsea tree 22. For example, to remove the tubing hanger 26, the well bore 20 may be plugged to block the flow of product into the environment. Next, the cap 52 may be removed to provide access to the tubing hanger 26. Finally, the tubing hanger 26 and attached tubing string 57 may be retrieved via a rig, for example. Because the subsea tree 22 does not block access to the longitudinal passage 34 of the spool 24, the tree 22 may remain attached to the spool 24 during the tubing hanger retrieval process. Consequently, maintenance costs may be significantly reduced compared to vertical tree configurations in which the vertical tree is removed prior to accessing the tubing hanger 26.

It should be appreciated that the embodiment shown in FIG. 2 may be used a subsea or surface system.

Figure 3:
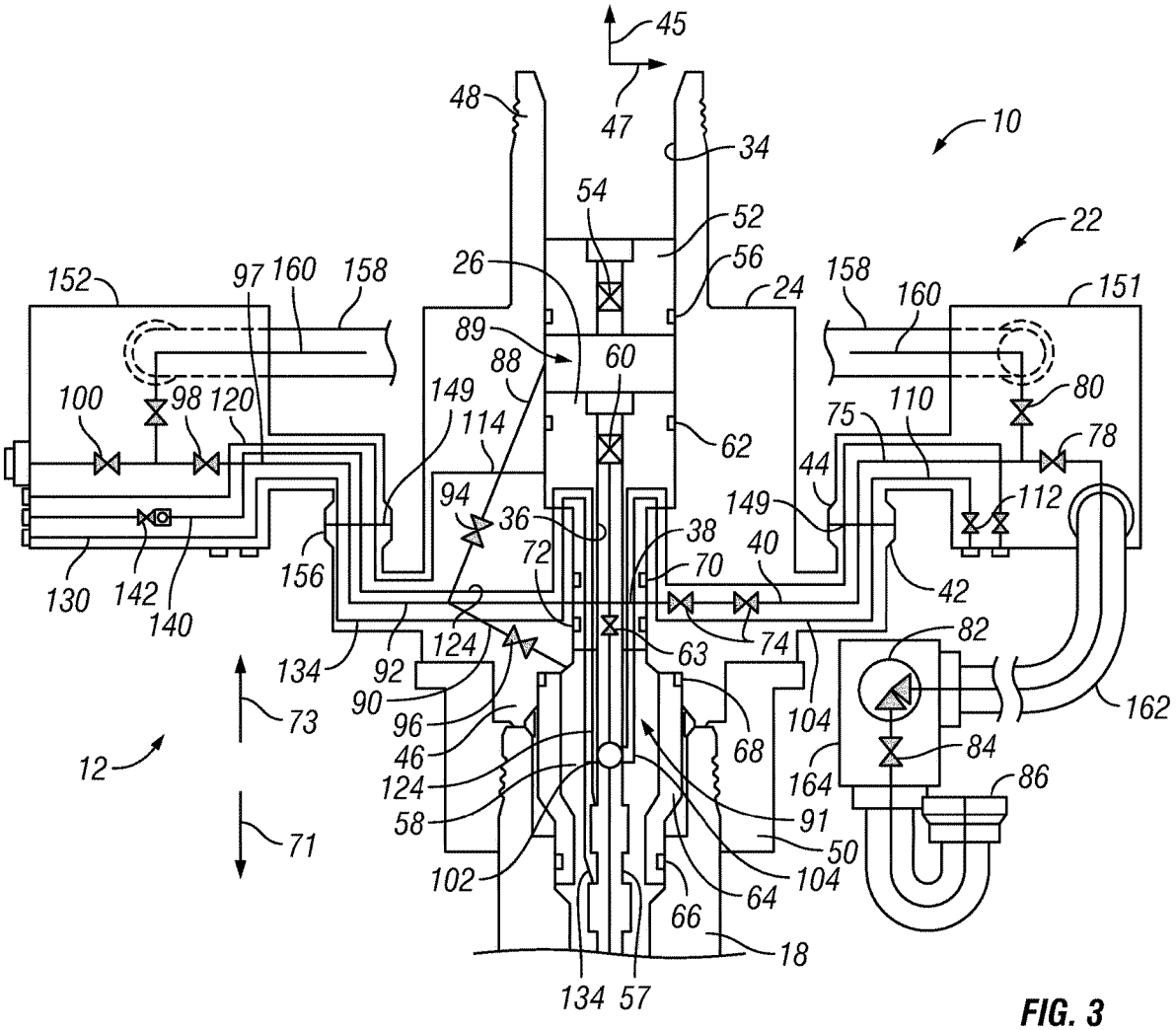
FIG. 3 is a cross-sectional side view of an illustrative, embodiment of a completion system arrangement where the structure is circumferentially disposed about the spool.

FIG. 3 is a cross-sectional side view of another embodiment of the spool 24 and subsea tree 22 that may be used in the completion system 10 of FIG. 1. In this, the subsea tree 22 includes a structure that is circumferentially disposed about the spool 24, as compared to the embodiments described above, in which the subsea tree structure is positioned at one circumferential location radially outward from the spool 24. As discussed in detail below, the structure of the subsea tree 22 may be substantially equally balanced in the radial direction 47, thereby facilitating the running and/or retrieval processes. In addition, because the valves may be positioned farther apart than the embodiments described above, a remote operated vehicle (ROV) may have enhanced access to valve actuators. While a cap 52 is employed in this embodiment with a plug 54, it should be appreciated that the tubing hanger 26 includes a fluid barrier 60 above the lateral flow passage 38 creating a dual-barrier configuration.

In the present embodiment, the subsea tree 22 is separated into a production valve block 151 and an annulus valve block 152. As illustrated, both valve blocks 151 and 152 are disposed radially outward from the spool 24, with each valve block located at a different circumferential position. As mentioned above, production valve block is not meant to limit the valve block 151 only to production, as it may also be used for injection. As discussed in detail below, the production valve block 151 is supported by a frame that circumferentially extends about the spool 24. In the present embodiment, the production valve block 151 includes the production flow passage 75 and the SCSSV hydraulic conduit 110, while the annulus valve block 152 includes the annulus flow passage 97, the vent/test conduit 120, the chemical injection conduit 130, and the sliding sleeve hydraulic conduit 140. However, it should be appreciated that the conduits 110, 120, 130 and 140 may be disposed within a different valve block in alternative embodiments. For example, in certain embodiments, the production valve block 151 may contain each of the conduits 110, 120, 130 and 140, while the annulus valve block 152 only includes the annulus flow passage 97. Alternatively, the annulus valve block 152 may contain each of the conduits 110, 120, 130 and 140, while the production valve block 151 only includes the production flow passage 75. It should be appreciated that corresponding lines extending from the subsea tree 22 to the surface may be connected to the appropriate valve block to establish a fluid connection with the conduits 110, 120, 130 and 140.

As illustrated, the production valve block 151 includes the mating hub connection 44 configured to interface with the hub connection 42. In the present embodiment, the hub connection 42 interfaces with the mating hub connection 44 along a plane 149 substantially perpendicular to the longitudinal passage 34 of the spool 24. However, it should be appreciated that the hub connection 42 may interface with the mating hub connection 44 along a plane substantially parallel to the longitudinal passage 34 in alternative embodiments. As illustrated, the interface between the hub connection 42 and the mating hub connection 44 establishes fluid connections between the lateral flow passage 40 and the production flow passage 75, and between the SCSSV conduits 104 and 110.

Similarly, the annulus valve block 152 includes an annulus connector 154 configured to interface with an annulus hub 156 of the spool 24. In the present embodiment, the annulus hub 156 interfaces with the annulus connector 154 along a plane 149 substantially perpendicular to the longitudinal passage 34 of the spool 24. However, it should be appreciated that the annulus hub 156 may interface with the annulus connector 154 along a plane substantially parallel to the longitudinal passage 34 in alternative embodiments. As illustrated, the interface between the annulus hub 156 and the annulus connector 154 establishes fluid connections between the annulus lateral flow passage 92 and the annulus flow passage 97 within the subsea tree 22. In addition, connections are established between the vent/test conduits 114 and 120, between the chemical injection conduits 124 and 130, and between the sliding sleeve hydraulic conduits 134 and 140. Consequently, each conduit within the spool 24 is fluidly coupled to a corresponding conduit with the subsea tree 22.

In another embodiment, the subsea tree 22 includes an annulus crossover loop 158 extending between the annulus valve block 152 and the production valve block 151. As illustrated, the annulus crossover loop 158 contains an annulus conduit 160 extending between the annulus flow passage 97 and the annulus crossover valve 80, thereby establishing a fluid connection between the annulus 58 and the tubing string 57. The subsea tree 22 also includes a fluid flow loop 162 extending between the production valve block 151 and a production choke assembly 164. As illustrated, the production choke assembly 164 includes the choke 82 and the flowline isolation valve 84. The flow loop 162 contains the flow passage 75, thereby establishing a fluid connection between the valve 78 and the choke 82. Furthermore, the flowline connection hub 86 is coupled to the choke assembly 164 to facilitate fluid flow between the subsea tree 22 and the surface. Because the components of the subsea tree 22 are circumferentially distributed about the spool 24, the tree 22 may be substantially balanced, thereby facilitating running and retrieving operations. However, in this embodiment, a cap 52 includes a fluid barrier 54, and it should be appreciated that the tubing hanger 26 also includes a fluid barrier 60 to create the dual-barrier configuration.

Figure 4:
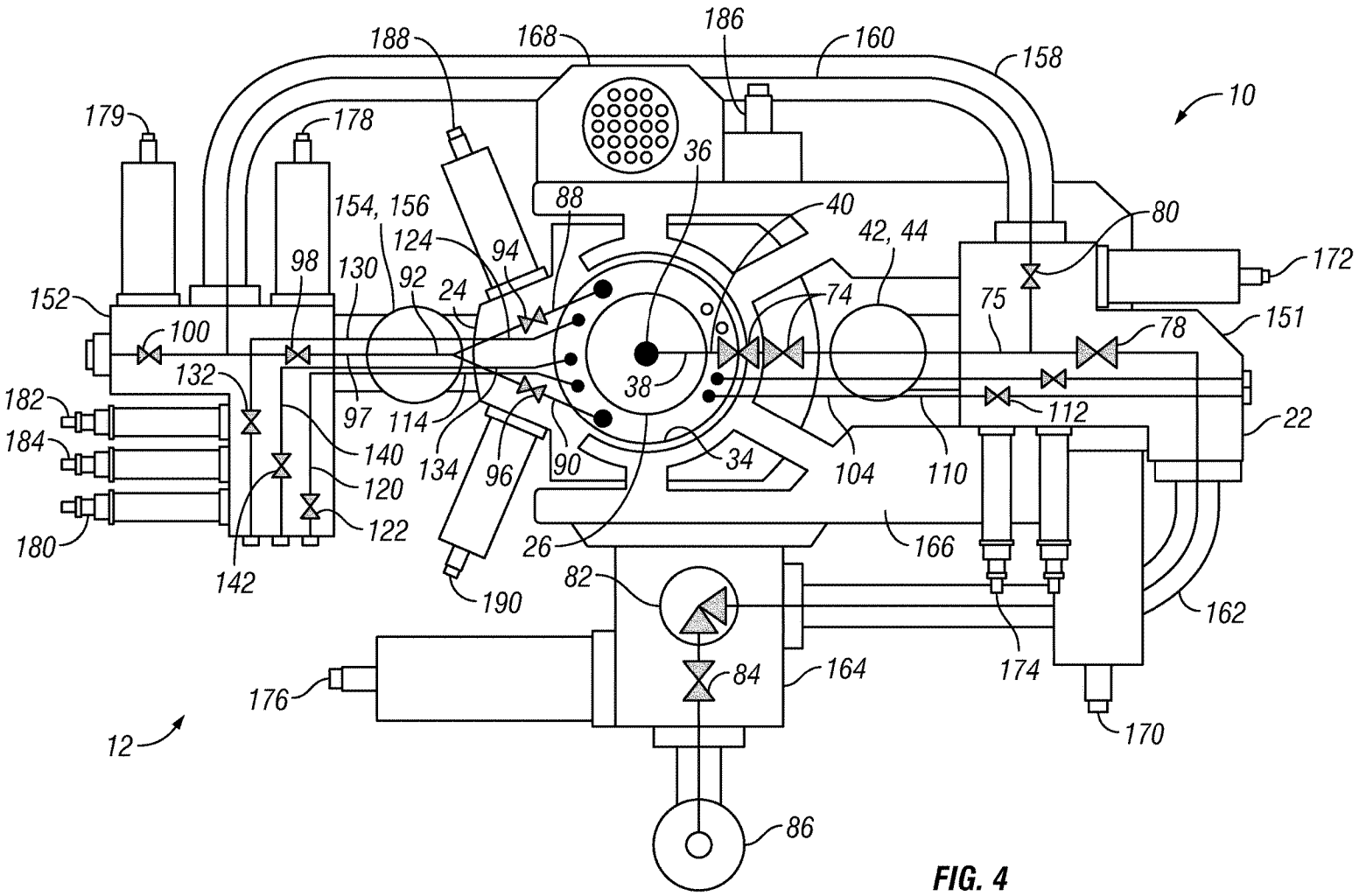
FIG. 4 is a top view of the completion system arrangement shown in FIG. 3.

FIG. 4 is a top view of the spool 24 and subsea tree 22 shown in FIG. 3. As previously discussed, the subsea tree 22 includes a frame 166 circumferentially disposed about the spool 24 and configured to support the production valve block 151. As illustrated, the frame 166 also supports the choke assembly 164 and an electronic control pod 168. In contrast, the annulus valve block 152 is supported by the annulus cross over loop 158 and the annulus connector 154. However, because the present annulus valve block 152 only includes a limited number of valves, the weight of the valve block 152 may not induce significant stress within the loop 158 or the connector 154. Because the structure of the subsea tree 22 is circumferentially disposed about the spool 24, the subsea tree 22 may be substantially balanced, thereby facilitating running and retrieving operations.

In addition, because the valves are located in various circumferential positions within the subsea tree 22, an ROV may have enhanced access to valve actuators. For example, in the present embodiment, the production valve block 151 includes a production valve actuator 170 configured to control the production valve 78, an annulus crossover valve actuator 172 configured to control the annulus crossover valve 80, and an SCSSV valve actuator 174 configured to control the SCSSV valve 112. In addition, the choke assembly 164 includes a flowline isolation valve actuator 176 configured to control the flowline isolation valve 84. Furthermore, the annulus valve block 152 includes an annulus valve actuator 178 configured to control the annulus valve 98, an annulus monitor valve actuator 179 configured to control the annulus monitor valve 100, a vent/test valve actuator 180 configured to control the vent/test valve 122, a chemical injection valve actuator 182 configured to control the chemical injection valve 132, and a sliding sleeve valve actuator 184 configured to control the sliding sleeve valve 142. By circumferentially distributing the actuators about the tree 22, the ROV may readily access each actuator. In addition, the spool 24 includes valve actuators configured to control the valves within the spool 24. Specifically, the spool 24 includes a production valve actuator 186 configured to control the production valve 74, an upper annulus valve actuator 188 configured to control the upper annulus valve 94, and a lower annulus valve actuator 190 configured to control the lower annulus valve 96.

It should be appreciated that the embodiment shown in FIGS. 3 and 4 may be used a subsea or surface system.

Figure 5:
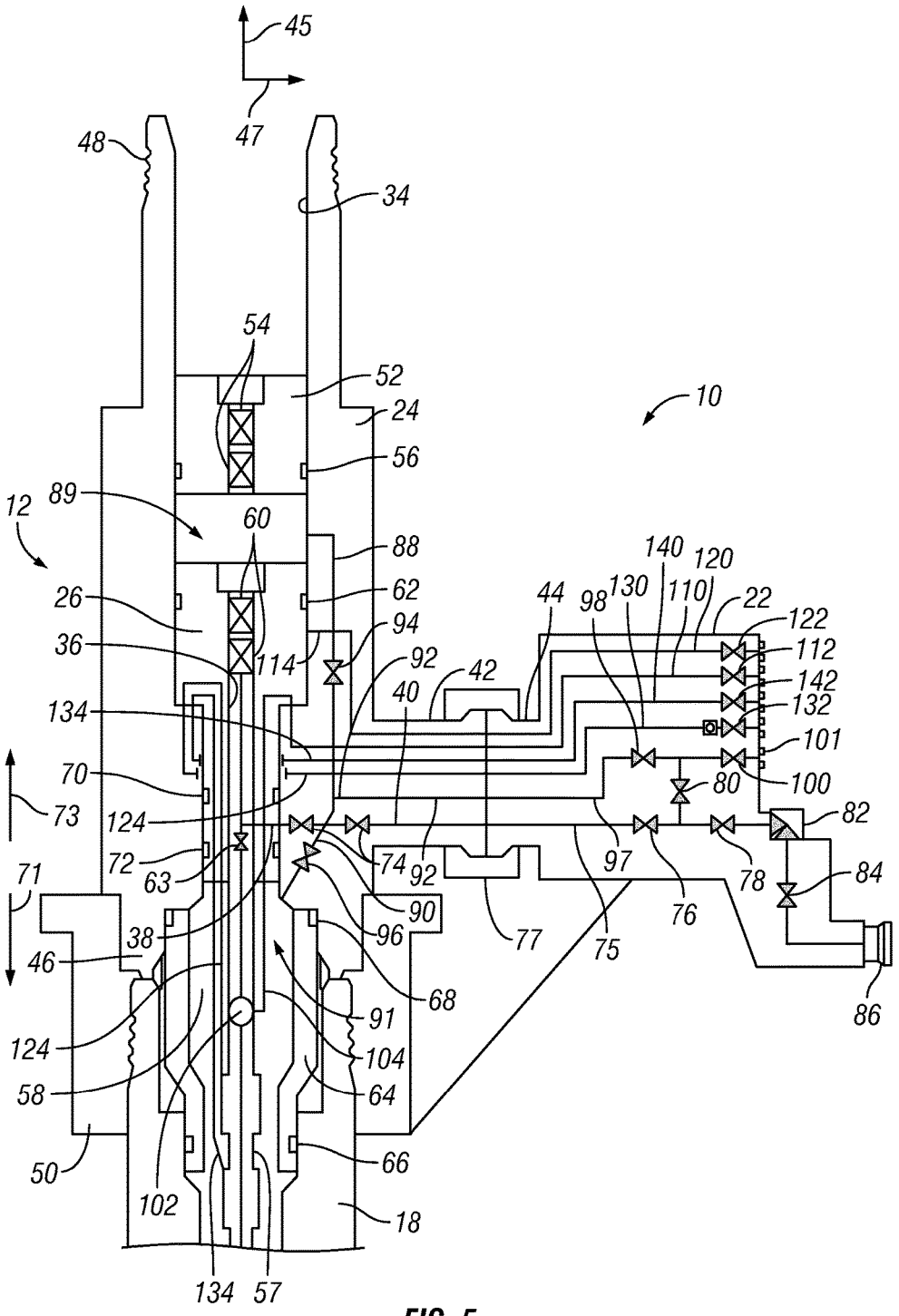
FIG. 5 is a cross-sectional side view of an alternative embodiment of the completion system.

In FIG. 5, another embodiment is presented including fluid barriers 54 in the cap 52 and fluid barriers 60 in the tubing hanger 26, similar to the embodiment shown in FIG. 2. It should be appreciated that the following discussion regarding fluid barriers may also be used in an embodiment similar to the embodiment shown in FIGS. 3 and 4. As with previous embodiments, the tubing hanger 26 may also include a profile for installing a fluid barrier 60 in the hanger longitudinal passage 36. Thus, a fluid barrier 60 such as a plug or an actuatable valve may be interchangeable in the profile. In the embodiment shown in FIG. 5, more than one barrier 54 is shown in the cap 52 and more than one barrier 60 is shown in the tubing hanger 26. Although the barriers 60 are both shown above the lateral flow passage 38 in the tubing hanger 26, it should be appreciated that one or both of the barriers may also be located below the lateral flow passage 38. As mentioned in the discussion above with respect to FIG. 2, more than one of the barriers 54, 60 may be an adjustable fluid barrier, such as an actuatable valve. Additionally, at least one of the barriers 54, 60 is an adjustable barrier. If not an adjustable barrier, the remaining barriers 54, 60 are non-adjustable barriers, such as removable plugs. Any combination of barriers where at least one of the barriers is adjustable may be used. For example, all of the barriers 54, 60 may be adjustable barriers. Additionally, if the tubing hanger 26 includes two barriers 60, then the cap 52 is not necessary and need not be used.

The adjustable barrier may include a valve (or valves) that serve as the fluid barrier that can open and close the passage in the cap 52 and or the longitudinal passage 36 in the tubing hanger 26 to allow direct downhole access during a subsea workover operation. In at least some configurations, this can be done without having to pull plugs when the tubing hanger passage is open, thus allowing passage to the production tubing.

An example of the utility of using an adjustable barrier is that an alternate downhole fluid path for well circulation can be achieved by opening the valve(s) 54 in the cap longitudinal passage. With the valve(s) open, fluid may be pumped down through the cap 52 to above the tubing hanger 26 and into an opened annulus crossover circulation loop in the tree. The annulus crossover circulation loop connects to the production master valve passage run extending through the tree and hanger and then connecting to the tubing hanger vertical passage just below a tubing hanger barrier and therefore down into the production tubing. Alternatively or additionally, fluid may flow through the barriers 54 as communicated with the production tubing annulus 58 through the upper annulus flow passage 88 and a lower annulus flow passage 90 in the spool 24.

In this or other embodiments, having a valve that can open and close the longitudinal passage in the tubing hanger passage will allow direct down hole mechanical and circulation access during a subsea workover operation, without having to pull plugs. In this configuration, the master valve located in the tubing head spool could be now located in the upper tree section.

It should be appreciated that the embodiment shown in FIG. 5 may be used a subsea or surface system.

Figure 6:
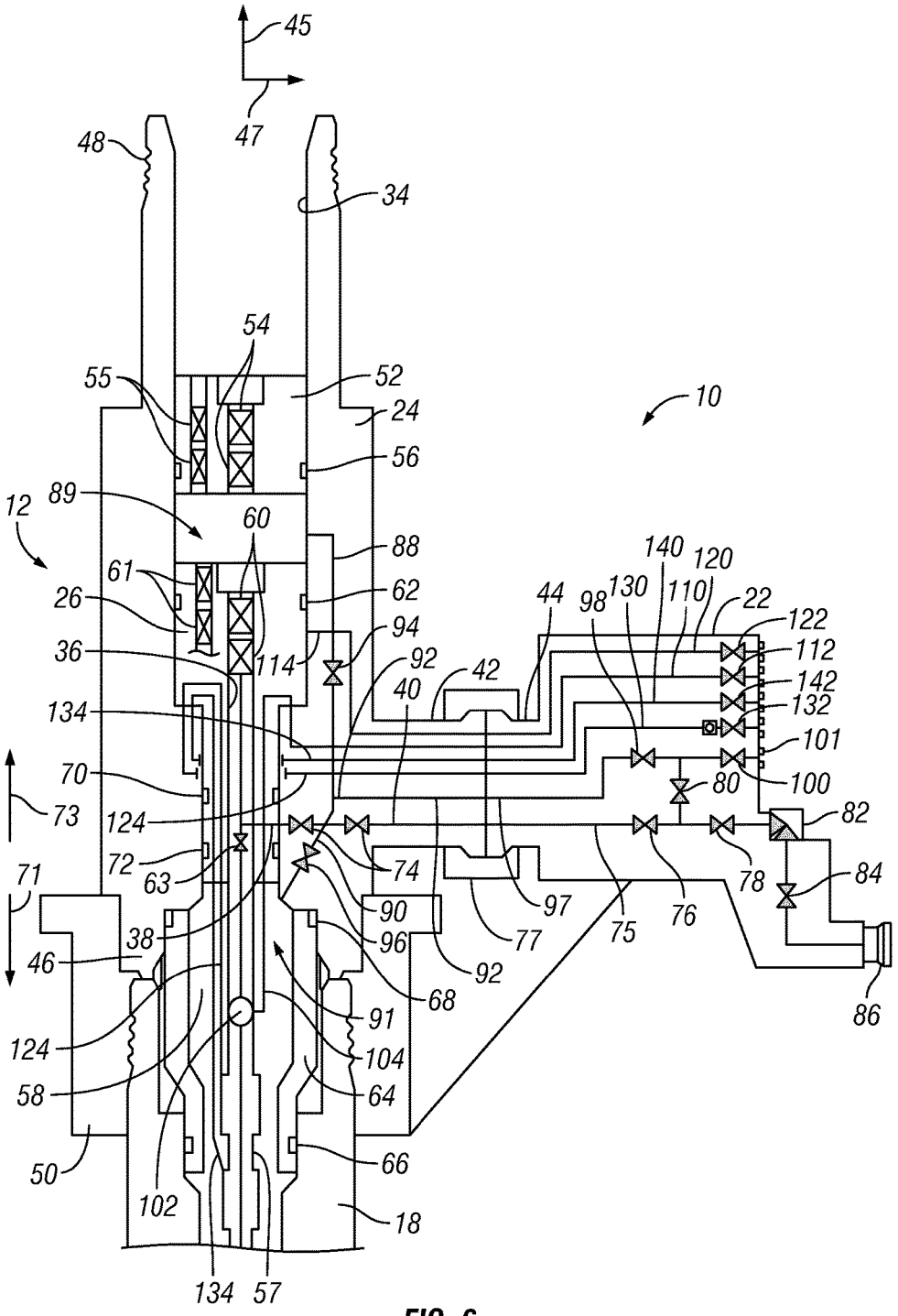
FIG. 6 is a cross-sectional side view of another alternative embodiment of the completion system.

In FIG. 6, an alternate or additional embodiment incorporating an annulus access valve(s) 55 located in an annulus access passage in the cap 52 separate from and adjacent to the longitudinal passage will also allow well circulation. This is achieved by pumping fluid through the choke and kill lines located below closed rams and through the riser down to the cap. The valve(s) 55 in the cap 52 is then opened allowing the fluid (or gas) to circulate below the cap 52 as discussed above.

An alternate or additional arrangement further incorporates an annulus access valve(s) 61 in annulus access passage not located in the tubing hanger longitudinal passage 36 but adjacent to it will also allow annulus access from above the tubing hanger 26 to below the tubing hanger 26. When used with or without the cap barriers 54 or annulus access valve(s) 55, fluid may circulate between above the cap 52 and the production tubing annulus 58 going through the tubing hanger 26 itself. This would eliminate the need for an annulus route typically located in the tree or spool body which by-passes the tubing hanger 26.

It should be appreciated that the embodiment shown in FIG. 6 may be used a subsea or surface system.

Figure 7:
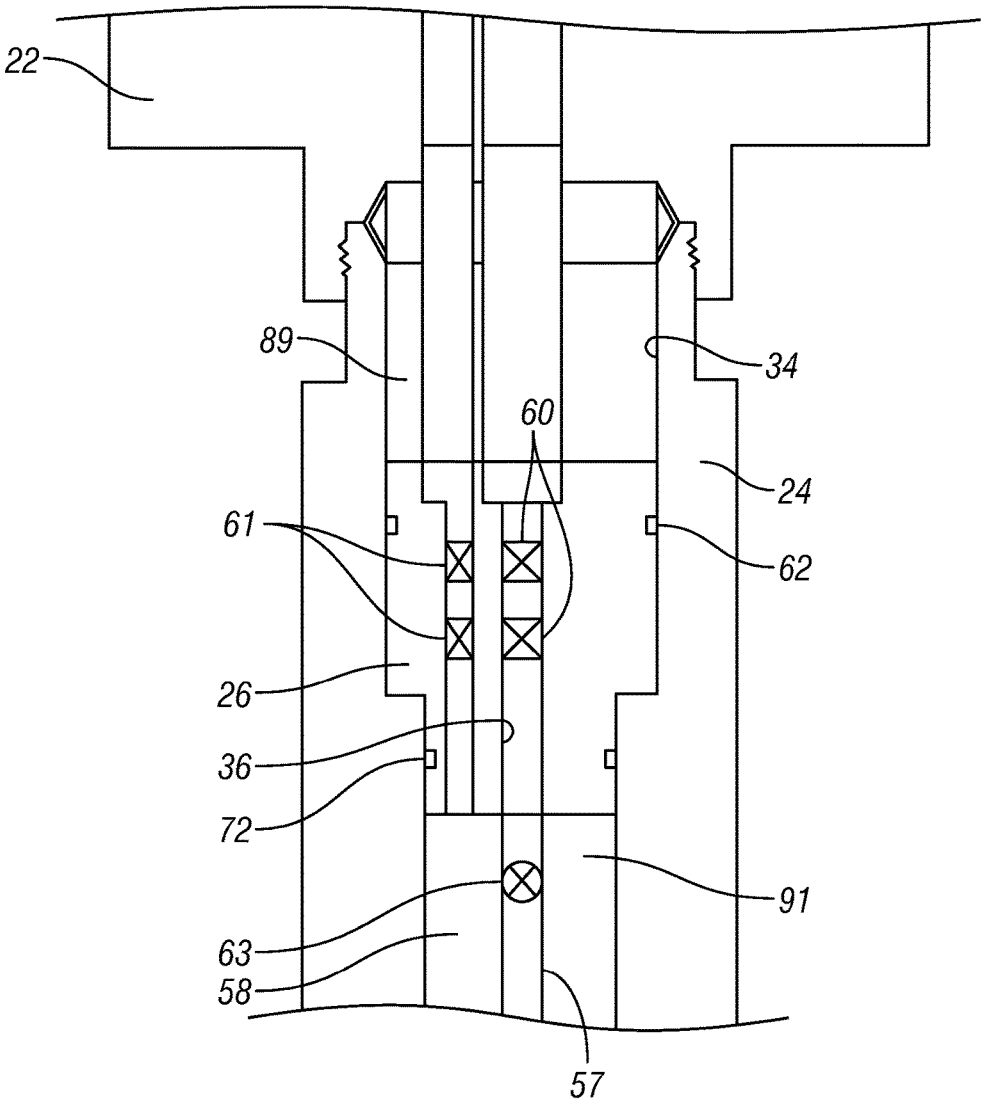
FIG. 7 is a cross-sectional side view of another alternative of the completion system.

In FIG. 7, another embodiment is presented including fluid barriers 60 in the tubing hanger 26, similar to the embodiment shown in FIG. 5. It should be appreciated that the following discussion regarding fluid barriers may also be used in an embodiment similar to the embodiment shown in FIGS. 5 and 6. As with previous embodiments, the tubing hanger 26 may also include a profile for installing a fluid barrier 60 in the hanger longitudinal passage 36. Thus, a fluid barrier 60 such as a plug or an actuatable valve may be interchangeable in the profile. In the embodiment shown in FIG. 7, the tubing hanger 24 is landed in the spool 24 and a subsea vertical tree 22 is connected with the spool 24. The vertical subsea tree 22 is in fluid communication with the tubing hanger longitudinal passage 36 to transfer the fluid between the spool 24 to the vertical subsea tree 22. The spool 24 may either be a tubing head spool or a high pressure wellhead housing.

More than one barrier 60 is shown in the longitudinal passage 36 of the tubing hanger 26. As mentioned in the discussion above with respect to FIG. 5, more than one of the barriers 60 may be an adjustable fluid barrier, such as an actuatable valve. Additionally, at least one of the barriers 60 is an adjustable barrier. If not an adjustable barrier, the remaining barriers 60 are non-adjustable barriers, such as removable plugs. Any combination of barriers where at least one of the barriers is adjustable may be used. For example, all of the barriers 60 may be adjustable barriers.

The adjustable barrier may include a valve (or valves) that serve as the fluid barrier that can open and close the passage in the longitudinal passage 36 in the tubing hanger 26 to allow direct downhole access during a subsea workover operation. In at least some configurations, this can be done without having to pull plugs when the tubing hanger passage is open, thus allowing passage to the production tubing.

In the embodiment shown in FIG. 7, the tubing hanger 26 includes a fluid barrier 63, such as an actuatable valve or other closure element below the tubing hanger 26. The valve 63 is configured to selectively block product flow to the subsea tree 22 and may be operated hydraulically or otherwise. The valve 63 may also be included in a sub or other extension below the tubing hanger 26. The valve 63 works together with the barrier(s) 60 but also with the valve 102 (not shown) to provide an environmental barrier to production fluid flow when the subsea tree 22 is not installed.

Also shown in FIG. 7 are optional annulus access valve(s) 61 in annulus access passage 65 not located in the tubing hanger longitudinal passage 36 but adjacent to it will also allow annulus access from above the tubing hanger 26 to below the tubing hanger 26. Annulus access valve(s) 61 would eliminate the need for an annulus route typically located in the tree or spool body which by-passes the tubing hanger 26. Although not shown, the spool 24 may also include an upper annulus flow passage and a lower annulus flow passage as discussed above to regulate pressure within an upper region 89 above the tubing hanger 26 and a lower region 91 below the tubing hanger 26, respectively.

An example of the utility of using an adjustable barrier is that an alternate downhole fluid path for well circulation can be achieved by opening the adjustable barriers 60, 61 in the tubing hanger 26. With the valve(s) open, fluid may flow through the hanger longitudinal passage 36 and the annulus access passage 65 to circulate fluid in the well. In this or other embodiments, having a valve that can open and close the production passage in the tubing hanger passage will allow direct down hole mechanical and circulation access during a subsea workover operation, without having to pull plugs.

It should be appreciated that the embodiment shown in FIG. 7 may be used a subsea or surface system.

In all of the embodiments described above and shown in FIGS. 1-7, accessing either or both of the tubing hanger longitudinal passage 36 and the cap longitudinal passage could save the operator time and money as opposed to the required steps necessary to pull plugs to gain access. In addition, the embodiments eliminate any potential issues previously seen involving the removal of stuck plugs or the re-establishment of new plugs in a damaged or debris filled passage. Additionally, all of the embodiments shown in FIGS. 1-7 may be used a subsea or surface system.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system for accessing well, comprising:

a spool comprising a longitudinal passage;

a tubing hanger installable and supportable in the spool longitudinal passage and comprising a hanger longitudinal passage through the tubing hanger and an annulus access passage through the tubing hanger; and fluid barriers within the hanger longitudinal passage and the annulus access passage, the fluid barriers including at least one adjustable barrier within the hanger longitudinal passage to control access to the well and at least two adjustable barriers within the annulus access passage to control access to an annulus below the tubing hanger.

2. The system of claim 1, wherein the at least one adjustable barrier within the hanger longitudinal passage comprises an actuatable valve.

3. The system of claim 2, further comprising more than one actuatable valve in the tubing hanger.

4. The system of claim 1, further comprising:

a cap supportable by the spool and comprising a cap longitudinal passage through the cap in communication with the spool longitudinal passage; and an adjustable barrier located in the cap longitudinal passage to control access to the well.

5. The system of claim 4, wherein the adjustable barrier in the cap comprises an actuatable valve.

6. The system of claim 5, further comprising more than one actuatable valve in the cap.

7. The system of claim 4, the cap further comprising an actuatable valve in an annulus access passage extending through the cap and separate from the cap longitudinal passage.

8. The system of claim 4, wherein the cap comprises an internal tree cap or an external tree cap.

9. The system of claim 1, wherein each of the at least two adjustable barriers within the annulus access passage comprises an actuatable valve.

10. The system of claim 1, further comprising a vertical tree in fluid communication with the hanger longitudinal passage.

11. The system of claim 1, further comprising an additional fluid barrier below the tubing hanger and in communication with the hanger longitudinal passage.

12. The system of claim 1, further comprising:

a production tubing suspended from the tubing hanger, an inside of the production tubing being in fluid communication with the hanger longitudinal passage; and the spool comprising an annulus flow passage open to and extending between an upper region above the tubing hanger and a lower region below the tubing hanger in fluid communication with an area surrounding the outside of the production tubing.

13. The system of claim 1, wherein the spool comprises a lateral flow passage extending laterally from and in fluid communication with the hanger longitudinal passage.

14. The system of claim 13, further comprising a valve in the lateral flow passage.

15. The system of claim 13, further comprising:

a production tubing suspended from the tubing hanger, an inside of the production tubing being in fluid communication with the hanger longitudinal passage; and an additional fluid barrier below the lateral flow passage in fluid communication with the hanger longitudinal passage.

16. The system of claim 15, wherein the additional fluid barrier is below the tubing hanger.

17. The system of claim 1, wherein the spool comprises a horizontal production tree.

18. The system of claim 1, wherein the spool comprises a high pressure wellhead assembly.

19. The system of claim 1, wherein the spool is connected to a separate high pressure wellhead assembly.

20. A method for accessing a well, comprising:

landing a tubing hanger in a spool;

installing a cap to the spool above the tubing hanger;

operating an adjustable barrier in the tubing hanger to control access to the well through the tubing hanger from above the tubing hanger; and operating an adjustable barrier in an annulus access passage in the tubing hanger and a second adjustable barrier in the annulus access passage in the tubing hanger to control access to an annulus below the tubing hanger.

21. The method of claim 20, further comprising operating a second adjustable barrier in the tubing hanger to control access to the well through the tubing hanger.

22. The method of claim 21, further comprising operating an adjustable barrier below the tubing hanger to control access to the well.

23. The method of claim 20, further comprising operating an adjustable barrier in the cap to control access through the cap to below the cap.

24. The method of claim 23, further comprising operating a second adjustable barrier in the cap.

25. The method of claim 23, further comprising extending a tool into the well through the cap and the tubing hanger without removing the cap, the adjustable barrier in the cap, the tubing hanger, or the adjustable barrier in the tubing hanger operated to control access to the well from the spool.

26. The method of claim 23, further comprising flowing fluid into the well through the cap and the tubing hanger without removing the cap, the adjustable barrier in the cap, the tubing hanger, or the adjustable barrier in the tubing hanger operated to control access to the well from the spool.

27. The method of claim 20, further comprising operating an adjustable barrier in an annulus access passage in the cap to control access to the annulus below the tubing hanger.

28. The method of claim 27, further comprising operating a second adjustable barrier in the annulus access passage in the cap to control access to the annulus below the tubing hanger.

29. The method of claim 20, further comprising extending a tool into the well through the tubing hanger without removing the tubing hanger or the adjustable barrier operated to control access to the well from the spool.

30. The method of claim 20, further comprising flowing fluid into the well through the tubing hanger without removing the tubing hanger or the adjustable barrier operated to control access to the well from the spool.

31. A method for accessing a well, comprising:

landing a tubing hanger in a spool;

installing a cap to the spool above the tubing hanger;

operating an adjustable barrier in the cap to control access to the well through the cap from above the tubing hanger; and operating an adjustable barrier in an annulus access passage in the tubing hanger and a second adjustable barrier in the annulus access passage in the tubing hanger to control access to an annulus below the tubing hanger.

32. The method of claim 31, further comprising operating a second adjustable barrier in the cap to control access to the well through the cap.

33. The method of claim 32, further comprising operating an adjustable barrier below the tubing hanger to control access to the well.

34. The method of claim 31, further comprising operating an adjustable barrier in the tubing hanger to control access to the well through the tubing hanger.

35. The method of claim 34, further comprising operating a second adjustable barrier in the tubing hanger to control access to the well through the tubing hanger.

36. The method of claim 34, further comprising extending a tool into the well through the cap and the tubing hanger without removing the cap, the adjustable barrier in the cap, the tubing hanger, or the adjustable barrier in the tubing hanger operated to control access to the well from the spool.

37. The method of claim 34, further comprising flowing fluid into the well through the cap and the tubing hanger without removing the cap, the adjustable barrier in the cap, the tubing hanger, or the adjustable barrier in the tubing hanger operated to control access to the well from the spool.

38. The method of claim 31, further comprising operating an adjustable barrier in an annulus access passage in the cap to control access to the annulus below the tubing hanger.

39. The method of claim 38, further comprising operating a second adjustable barrier in the annulus access passage in the cap to control access to the annulus below the tubing hanger.

40. The method of claim 31, further comprising extending a tool into the well through the tubing hanger without removing the tubing hanger or the adjustable barrier in the cap from the spool.

41. The method of claim 31, further comprising flowing fluid into the well through the tubing hanger without removing the tubing hanger or the adjustable barrier in the cap from the spool.

42. A method for accessing a well, comprising:

landing a tubing hanger in a spool;

installing a cap to the spool above the tubing hanger;

operating an adjustable barrier in the tubing hanger to control access to the well through the tubing hanger from above the tubing hanger; and operating an adjustable barrier in an annulus access passage in the cap and a second adjustable barrier in the annulus access passage in the cap to control access to an annulus below the tubing hanger.

43. The method of claim 42, further comprising operating a second adjustable barrier in the tubing hanger to control access to the well through the tubing hanger.

44. The method of claim 43, further comprising operating an adjustable barrier below the tubing hanger to control access to the well.

45. The method of claim 42, further comprising operating an additional adjustable barrier in the cap to control access through the cap to below the cap.

46. The method of claim 45, further comprising operating a second additional adjustable barrier in the cap.

47. The method of claim 45, further comprising extending a tool into the well through the cap and the tubing hanger without removing the cap, the additional adjustable barrier in the cap, the tubing hanger, or the adjustable barrier in the tubing hanger operated to control access to the well from the spool.

48. The method of claim 45, further comprising flowing fluid into the well through the cap and the tubing hanger without removing the cap, the additional adjustable barrier in the cap, the tubing hanger, or the adjustable barrier in the tubing hanger operated to control access to the well from the spool.

49. The method of claim 42, further comprising operating an adjustable barrier in an annulus access passage in the tubing hanger to control access to the annulus below the tubing hanger.

50. The method of claim 42, further comprising extending a tool into the well through the tubing hanger without removing the tubing hanger or the adjustable barrier operated to control access to the well from the spool.

51. The method of claim 42, further comprising flowing fluid into the well through the tubing hanger without removing the tubing hanger or the adjustable barrier operated to control access to the well from the spool.

52. A method for accessing a well, comprising:

landing a tubing hanger in a spool;

installing a cap to the spool above the tubing hanger;

operating an adjustable barrier in the cap to control access to the well through the cap from above the tubing hanger; and operating an adjustable barrier in an annulus access passage in the cap and a second adjustable barrier in the annulus access passage in the cap to control access to an annulus below the tubing hanger.

53. The method of claim 52, further comprising operating a second adjustable barrier in the cap to control access to the well through the cap.

54. The method of claim 53, further comprising operating an adjustable barrier below the tubing hanger to control access to the well.

55. The method of claim 52, further comprising operating an adjustable barrier in the tubing hanger to control access to the well through the tubing hanger.

56. The method of claim 55, further comprising operating a second adjustable barrier in the tubing hanger to control access to the well through the tubing hanger.

57. The method of claim 55, further comprising extending a tool into the well through the cap and the tubing hanger without removing the cap, the adjustable barrier in the cap operated to control access to the well, the tubing hanger, or the adjustable barrier in the tubing hanger operated to control access to the well from the spool.

58. The method of claim 55, further comprising flowing fluid into the well through the cap and the tubing hanger without removing the cap, the adjustable barrier in the cap operated to control access to the well, the tubing hanger, or the adjustable barrier in the tubing hanger operated to control access to the well from the spool.

59. The method of claim 52, further comprising operating an adjustable barrier in an annulus access passage in the tubing hanger to control access to the annulus below the tubing hanger.

60. The method of claim 52, further comprising extending a tool into the well through the tubing hanger without removing the tubing hanger or the adjustable barrier in the cap operated to control access to the well from the spool.

61. The method of claim 52, further comprising flowing fluid into the well through the tubing hanger without removing the tubing hanger or the adjustable barrier in the cap operated to control access to the well from the spool.

62. A method for accessing a well, comprising:

landing a tubing hanger in a spool;

operating an adjustable barrier in the tubing hanger to control access to the well through the tubing hanger from above the tubing hanger; and operating an adjustable barrier in an annulus access passage in the tubing hanger and a second adjustable barrier in the annulus access passage in the tubing hanger to control access to an annulus below the tubing hanger.

63. The method of claim 62, further comprising operating a second adjustable barrier in the tubing hanger to control access to the well through the tubing hanger.

64. The method of claim 63, further comprising operating an adjustable barrier below the tubing hanger to control access to the well.

65. The method of claim 62, further comprising operating an adjustable barrier in a cap above the tubing hanger to control access through the cap to below the cap.

66. The method of claim 65, further comprising operating a second adjustable barrier in the cap.

67. The method of claim 65, further comprising extending a tool into the well through the cap and the tubing hanger without removing the cap, the adjustable barrier in the cap, the tubing hanger, or the adjustable barrier in the tubing hanger operated to control access to the well from the spool.

68. The method of claim 65, further comprising flowing fluid into the well through the cap and the tubing hanger without removing the cap, the adjustable barrier in the cap, the tubing hanger, or the adjustable barrier in the tubing hanger operated to control access to the well from the spool.

69. The method of claim 62, further comprising operating an adjustable barrier in an annulus access passage in the cap to control access to the annulus below the tubing hanger.

70. The method of claim 69, further comprising operating a second adjustable barrier in the annulus access passage in the cap to control access to the annulus below the tubing hanger.

71. The method of claim 62, further comprising extending a tool into the well through the tubing hanger without removing the tubing hanger or the adjustable barrier operated to control access to the well from the spool.

72. The method of claim 62, further comprising flowing fluid into the well through the tubing hanger without removing the tubing hanger or the adjustable barrier operated to control access to the well from the spool.

* * * * *